US006065624A

United States Patent [19]

Steinke

[11] Patent Number: 6,065,624

[45] Date of Patent: May 23, 2000

[54] PLASTIC BLOW MOLDED WATER BOTTLE

[75] Inventor: James R. Steinke, Brooklyn, Mich.

[73] Assignee: Plastipak Packaging, Inc., Plymouth, Mich.

[21] Appl. No.: 09/182,551

[22] Filed: Oct. 29, 1998

[51] Int. Cl.[7] ..... B65D 90/02

[52] U.S. Cl. ..... 215/383; 215/373; 220/608; 220/672; 220/675

[58] Field of Search ..... 220/606, 672, 220/607, 675, 608; 215/383, 373; D9/502

[56] References Cited

U.S. PATENT DOCUMENTS

| | | | |
|---|---|---|---|
| D. 397,941 | 9/1998 | Lauth | D9/502 |
| D. 404,306 | 1/1999 | Steinke | D9/502 |
| 4,108,324 | 8/1978 | Krishnakumar et al. | 215/373 |
| 4,247,012 | 1/1981 | Alberghini et al. | 215/373 |
| 4,497,855 | 2/1985 | Agrawal et al. | 215/373 |
| 4,525,401 | 6/1985 | Pocock et al. | 215/373 X |
| 4,620,639 | 11/1986 | Yoshino | 215/373 |
| 4,798,300 | 1/1989 | Ghosh et al. | 215/373 X |
| 4,993,566 | 2/1991 | Eberle | 215/373 |
| 5,071,015 | 12/1991 | Kinslow | 220/606 X |
| 5,713,480 | 2/1998 | Petre et al. | 215/373 |
| 5,732,838 | 3/1998 | Young . | |

*Primary Examiner*—Stephen P. Garbe
*Assistant Examiner*—Tri M. Mai
*Attorney, Agent, or Firm*—Brooks & Kushman P.C.

[57] ABSTRACT

A plastic blow molded water bottle (10) of a round shape has a body portion (12), an upper dispensing end (18), and a lower base (32) constructed in a manner that provides improved ability to withstand internal pressure.

2 Claims, 3 Drawing Sheets

PLASTIC BLOW MOLDED WATER BOTTLE

TECHNICAL FIELD

This invention relates to a plastic blow molded water bottle having an improved construction for holding internal pressure.

BACKGROUND ART

Plastic blow molded bottles for holding water such as disclosed by U.S. Pat. No. 5,732,838 Young must be designed to withstand internal pressure that is utilized to provide the filled bottle with rigidity. This internal pressure is normally only about one-half to one atmospheric gauge pressure and is thus substantially less than the pressure held by bottles that hold carbonated beverages. Nevertheless, the lower base on which the water bottle sits must be constructed so that its conventional upwardly extending central portion does not invert downwardly because of the internal pressure.

DISCLOSURE OF INVENTION

An object of the present invention is to provide a plastic blow molded water bottle having an improved construction for withstanding internal pressure.

In carrying out the above object, the plastic blow molded water bottle has a round shape with a central axis and includes a generally cylindrical body portion having upper and lower ends. An upper dispensing end of the bottle has a shoulder extending upwardly and inwardly from the upper end of the body portion and has a dispensing spout extending upwardly from the shoulder. A lower base of the water bottle has a side wall extending downwardly and inwardly from the body portion and also has a lower annular support extending inwardly from the side wall to support the bottle in an upstanding manner on a horizontal support surface. A dome of the lower base extends upwardly and inwardly from the lower annular support. The dome includes an outer annular wall extending generally vertically, a dome portion extending upwardly and inwardly from the annular wall with a downwardly concave curved shape, strengthening ribs that extend outwardly in a radial direction from the central axis on the dome portion and have cross sections that project downwardly with an upwardly opening shape, and connections between the strengthening ribs and the outer annular wall.

The strengthening ribs have radial inner ends that converge outwardly with pointed shapes and radial outer ends of a uniform cross section. The maximum diameter of the lower base is about eight times the height of the dome above the support surface.

The body portion of the water bottle has an upper label panel that extends inwardly to provide label protection, and the body portion also includes a plurality of lower strengthening rings of annular shapes below the label panel.

The shoulder of the dispensing spout of the water bottle has a curvature in an elevational direction with a maximum radius that is less than one-half of the maximum diameter of the bottle. The bottle has an overall height that is about 2.68 times its maximum diameter and has a filling volume in fluid ounces below its dispensing spout that is about 2.62 times its overall height in inches.

The objects, features, and advantages of the present invention are readily apparent from the following detailed description of the best mode for carrying out the invention when taken in connection with the accompanying drawings.

BEST MODE FOR CARRYING OUT THE INVENTION

Figure 1:
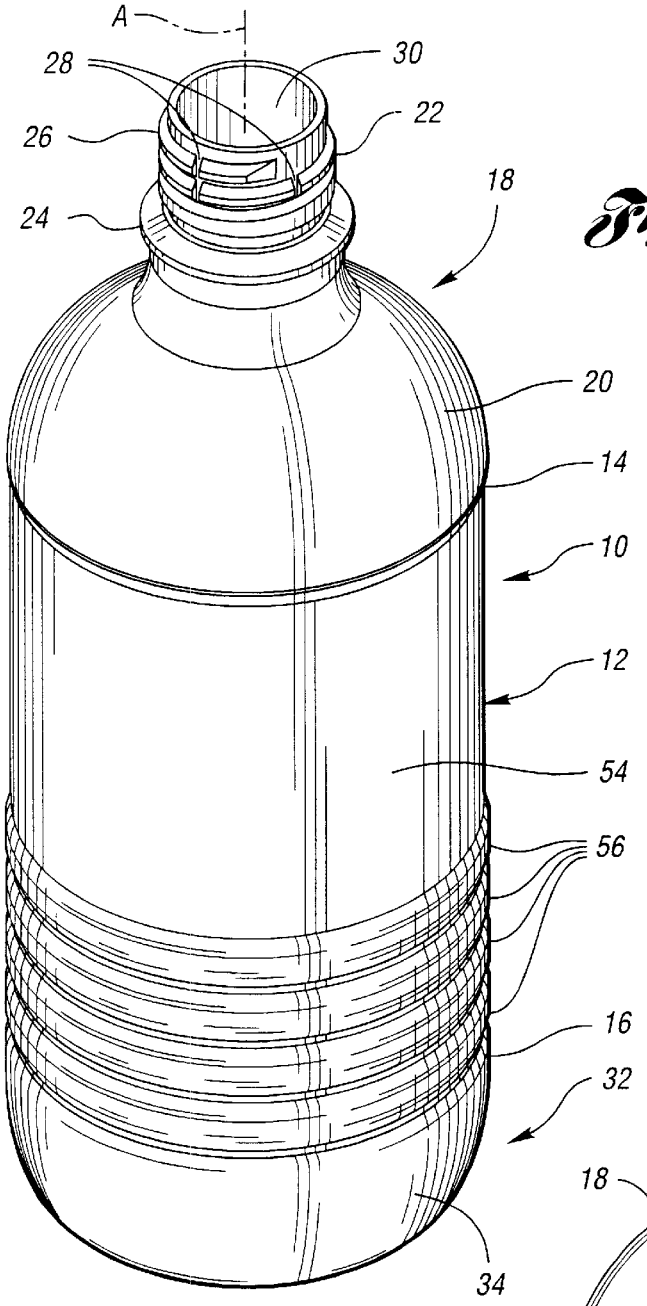
FIG. 1 is a perspective view taken from above and to the side of a plastic blow molded water bottle constructed in accordance with the present invention.
Figure 2:
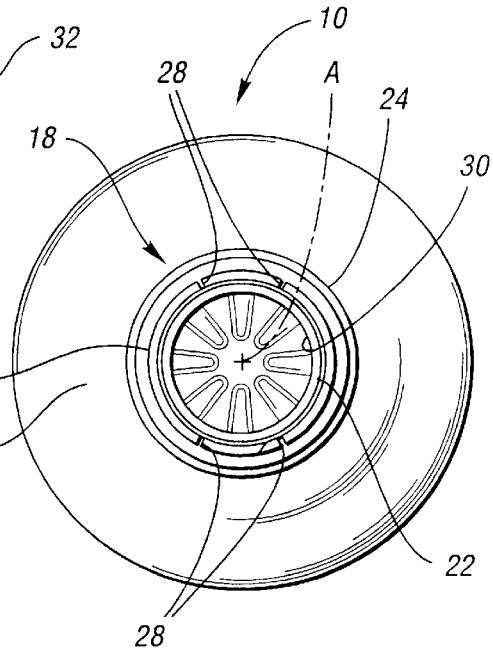
FIG. 2 is a top plan view of the water bottle.

With reference to FIGS. 1 through 4, a plastic blow molded water bottle 10 of a round shape is constructed in accordance with the present invention and has a central axis A. The water bottle 10 has a generally cylindrical body portion 12 that has upper and lower ends 14 and 16 as best identified in FIG. 3. An upper dispensing end 18 of the water bottle has a shoulder 20 extending upwardly and inwardly with a curved shape from the upper end 14 of the body portion 12. At the upper extremity of the shoulder 20, the upper dispensing end 18 includes a dispensing spout 22 that has an indexing ring 24, threads 26 for securing an unshown closure and with vertical thread grooves 28 for releasing internal pressure upon opening of the closure, and an opening 30 shown in FIGS. 2 and 3 for dispensing the water bottle contents.

Figure 5:
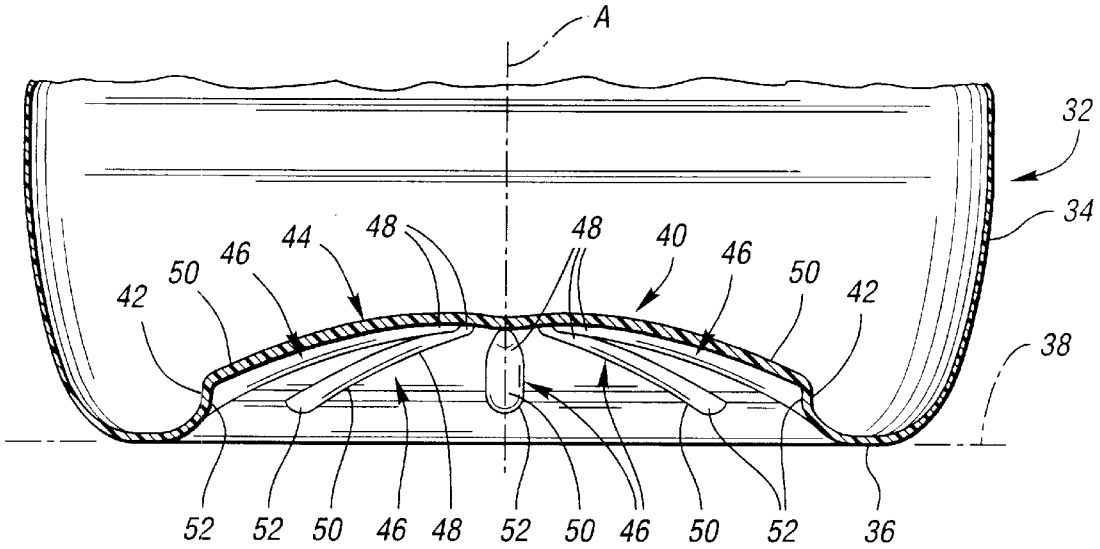
FIG. 5 is a sectional view of a lower base of the water bottle taken along the direction of line 5—5 in FIG. 4 between radial strengthening ribs.
Figure 6:
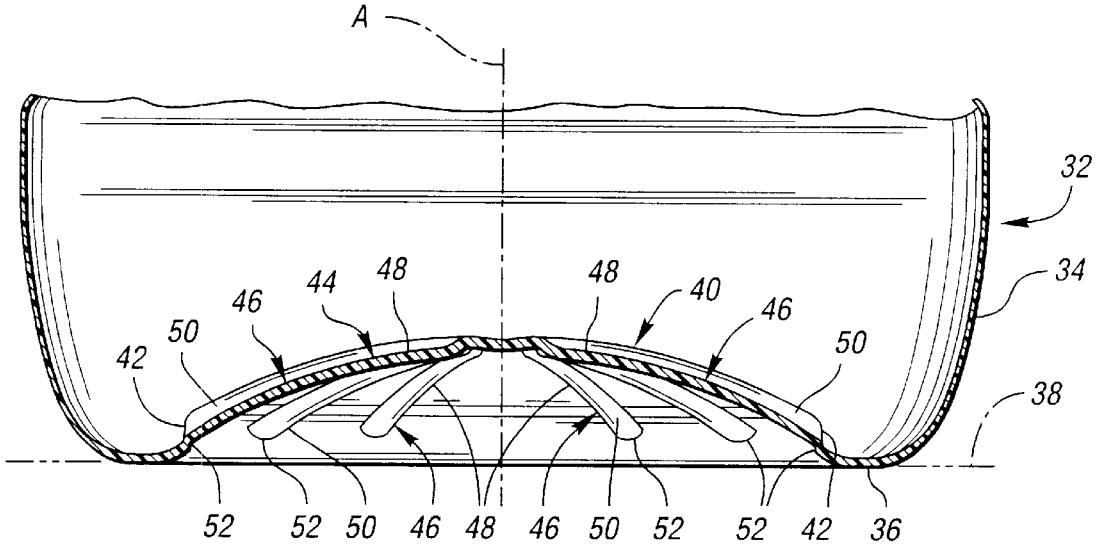
FIG. 6 is a sectional view of the lower base of the water bottle taken along the direction of line 6—6 in FIG. 4 through the radial strengthening ribs.
Figure 7:
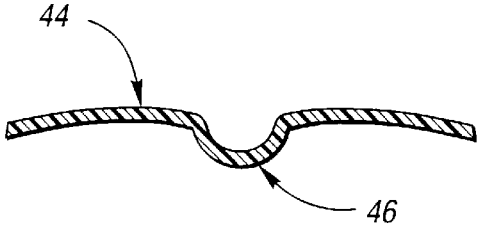
FIG. 7 is taken along the direction of line 7—7 in FIG. 4 to illustrate the cross section of the strengthening ribs.

Water bottle 10 also includes a lower base 32 having a side wall 34 extending downwardly and inwardly from the lower end 14 of the body portion 12. The lower base 32 as best shown in FIGS. 5 and 6 also has a lower annular support 36 extending inwardly from the side wall 34 to support the bottle in an upstanding manner on a horizontal support surface 38. A dome 40 of the lower base extends upwardly and inwardly from the lower annular support 36. This dome 40 includes an outer annular wall 42 that extends generally vertically in an upward direction from the lower annular support 36. A dome portion 44 of dome 40 extends upwardly and inwardly from the outer annular wall 42 with a downwardly concave curved shape. Strengthening ribs 46 best illustrated in FIGS. 4. 6 and 7 extend outwardly in a radial direction from the central axis A on the dome portion 40 and have cross sections that project downwardly as shown in FIG. 7 with an upwardly opening shape.

The water bottle 10 as described above is most preferably made by injection stretch blow molding wherein a heated plastic preform of a shorter height than the bottle height is axially stretched and then blown outwardly so as to have biaxial orientation. This water bottle is also most preferably made from polyethylene terephthalate with the biaxial orientation provided by the injection stretch blow molding.

Figure 4:
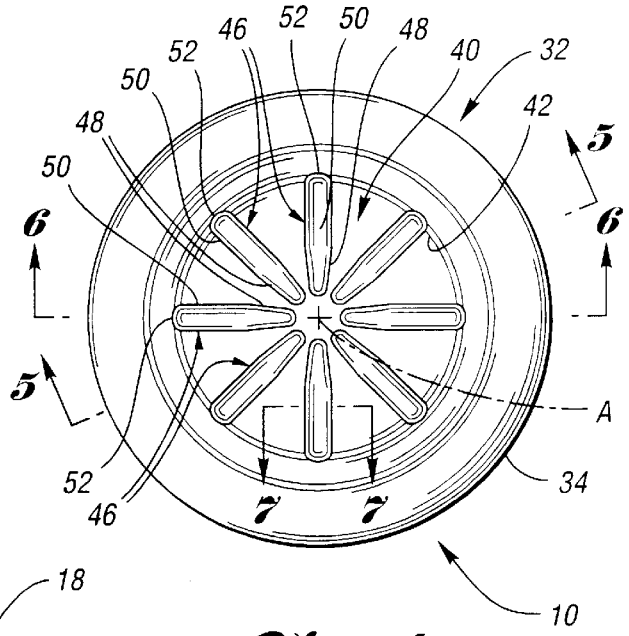
FIG. 4 is a bottom plan view of the water bottle.

As illustrated in FIG. 4, the strengthening ribs 46 have radial inner ends 48 with pointed shapes and have radial outer ends 50 of a uniform cross section. The radial outer extremity of the outer end 50 of each strengthening rib as shown in FIG. 6 has a connection 52 to the outer annular wall 42.

Figure 3:
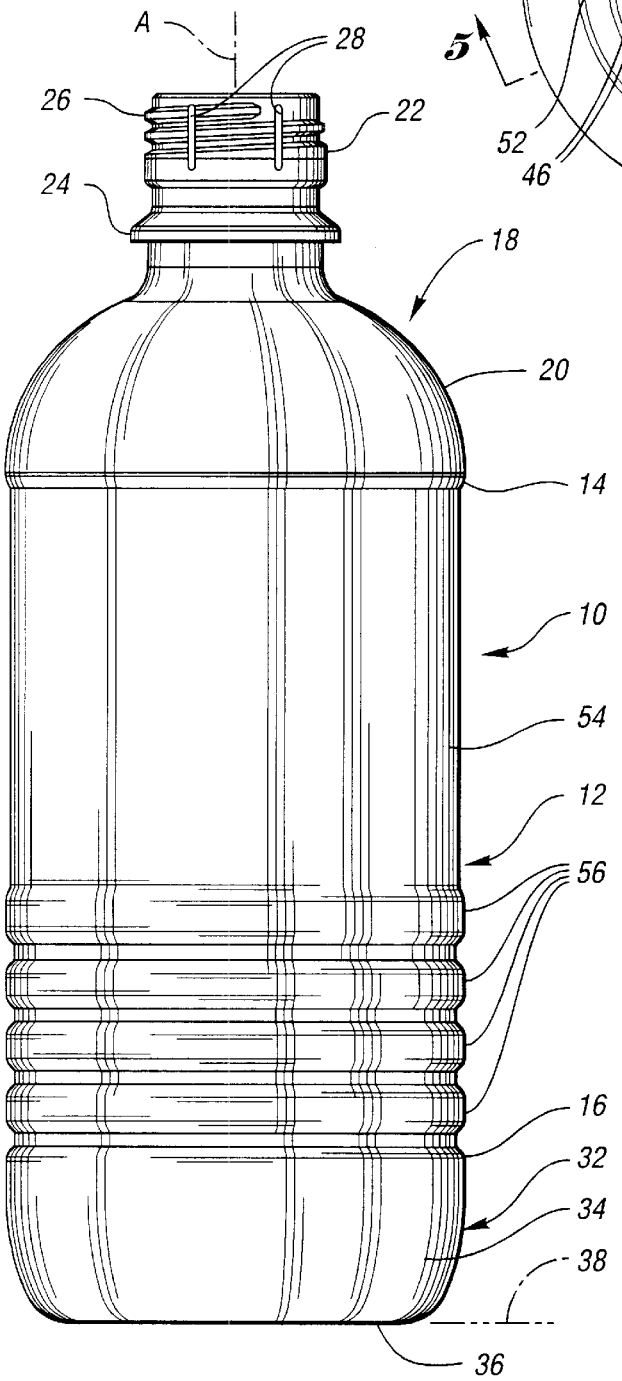
FIG. 3 is an elevational view of the water bottle.

As best illustrated in FIGS. 3 and 6, the maximum diameter of the lower base 32 as shown in FIG. 3 where it is connected to the lower end 14 of the body portion 12 is about eight times the height at the central axis A of the dome 40 above the support surface 38.

As shown in FIGS. 1 and 3, the body portion 12 of bottle 10 has an upper label panel 54 that extends inwardly from the shoulder 20 of the upper dispensing end 18 such that an applied label is protected. The body portion 12 also has a plurality of lower strengthening rings 56 of annular shapes below the label panel 54 whose lower end also extends inwardly from the uppermost ring to provide the label protection as previously mentioned. As illustrated, there are four of the strengthening rings 56 which have an outer diameter that is the same as the diameter of the lower end of the shoulder 20 and the upper end of the side wall 34 of lower base 32.

As illustrated in FIG. 3, the shoulder 20 has a curvature in an elevational direction with a maximum radius that is less than one-half of the maximum diameter of the water bottle and most preferably about one-third of the maximum bottle diameter.

The water bottle 10 as shown in FIG. 3 has a relatively stout construction and has an overall height that is about 2.68 times its maximum diameter. In addition, the bottle 10 has a filling volume in fluid ounces below its dispensing spout 22 that is about 2.62 times its overall height in inches.

While the best mode for carrying out the invention has been described in detail, those familiar with the art to which this invention relates will recognize various alternative designs and embodiments for practicing the invention as defined by the following claims.

What is claimed is:

1. A plastic blow molded water bottle of a round shape having a central axis and comprising:

a generally cylindrical body portion having upper and lower ends, the body portion having an upper label panel that extends inwardly to provide label protection, and the body portion including a plurality of lower strengthening rings below the label panel;

an upper dispensing end having a shoulder extending upwardly and inwardly from the upper end of the body portion with a curvature in an elevational direction with a maximum radius that is less than one-half of the maximum diameter of the bottle, and the upper dispensing end having a dispensing spout extending upwardly from the shoulder; and a lower base having a side wall extending downwardly and inwardly from the lower end of the body portion, a lower annular support extending inwardly from the side wall to support the bottle in an upstanding manner on a horizontal support surface, a dome extending upwardly and inwardly from the lower annular support, the maximum diameter of the lower base being about eight times the height of the dome above the support surface at the central axis, the dome including an outer annular wall extending generally vertically, a dome portion extending upwardly and inwardly from the outer annular wall with a downwardly concave curved shape, strengthening ribs that extend outwardly in a radial direction from the central axis on the dome portion and have cross sections that project downwardly with an upwardly opening shape, the strengthening ribs having radial inner ends that converge inwardly with pointed shapes and radial outer ends of a uniform cross section, and connections between the outer ends of the strengthening ribs and the outer annular wall.

2. A plastic blow molded bottle as in claim 1 wherein the bottle has an overall height at the central axis that is about 2.68 times its maximum diameter, and the bottle also having a filling volume in fluid ounces below its dispensing spout that is about 2.62 times its overall height in inches.

* * * * *